US008672182B2

(12) United States Patent
Bonet Pedrol

(10) Patent No.: US 8,672,182 B2
(45) Date of Patent: Mar. 18, 2014

(54) DISCHARGE SPOUT FOR FLEXIBLE BAGS

(75) Inventor: Jaume Bonet Pedrol, Badalona (ES)

(73) Assignee: Volpak, S.A.U., Santa Perpetua de Mogoda (ES)

( * ) Notice: Subject to any disclaimer, the term of this patent is extended or adjusted under 35 U.S.C. 154(b) by 263 days.

(21) Appl. No.: 13/054,433

(22) PCT Filed: Jul. 6, 2009

(86) PCT No.: PCT/EP2009/058476
§ 371 (c)(1),
(2), (4) Date: Mar. 3, 2011

(87) PCT Pub. No.: WO2010/006943
PCT Pub. Date: Jan. 21, 2010

(65) Prior Publication Data

US 2011/0147421 A1 Jun. 23, 2011

(30) Foreign Application Priority Data

Jul. 18, 2008 (ES) ..... 200802140

(51) Int. Cl.
*B65D 35/00* (2006.01)
*B65D 47/00* (2006.01)

(52) U.S. Cl.
USPC ..... 222/92; 222/107; 222/556

(58) Field of Classification Search
USPC ..... 222/107, 566, 567, 569, 572, 92, 94, 222/95, 96; 383/906, 80
See application file for complete search history.

(56) References Cited

U.S. PATENT DOCUMENTS

| | | | | | |
|---|---|---|---|---|---|
| 3,690,524 | A * | 9/1972 | Haberhauer | 222/573 |
| 4,126,167 | A * | 11/1978 | Smith et al. | 604/317 |
| 5,911,340 | A * | 6/1999 | Uematsu | 222/92 |
| 6,142,341 | A * | 11/2000 | Uematsu | 222/92 |
| 6,273,307 | B1 * | 8/2001 | Gross et al. | 222/566 |
| 7,661,560 | B2 * | 2/2010 | Murray | 222/107 |
| 7,762,430 | B2 * | 7/2010 | Wild et al. | 222/107 |
| 7,762,439 | B2 * | 7/2010 | Niggemyer et al. | 222/568 |
| 7,850,044 | B2 * | 12/2010 | Hildebrand et al. | 222/107 |
| 2006/0006194 | A1 * | 1/2006 | Niggemyer et al. | 222/107 |

FOREIGN PATENT DOCUMENTS

| | | | |
|---|---|---|---|
| ES | 2 300 230 | A1 | 6/2008 |
| FR | 2 890 380 | A1 | 3/2007 |
| WO | 03/031280 | A1 | 4/2003 |
| WO | 2005/014399 | A1 | 2/2005 |
| WO | 2005/066037 | A1 | 7/2005 |
| WO | 2007/067029 | A1 | 6/2007 |

* cited by examiner

*Primary Examiner* — Kevin P Shaver
*Assistant Examiner* — Stephanie E Williams
(74) *Attorney, Agent, or Firm* — Sughrue Mion, PLLC

(57) ABSTRACT

The invention relates to a discharge spout for flexible bags, of the type comprising a rigid plastic body forming a discharge passage and having a tube (3) intended to be inserted between two walls of a flexible bag and joined to such walls by means of sealing. The tube (3) has a smooth outer surface and two opposite flat flaps (4) extending externally in a mid-plane of said tube (3). The outer surface of the tube (3) forms, together with the surface (6) of the flat flaps (4), a sealing surface. The outer surface of the tube (3) has a middle area (5*a*), that is in the axial direction of the tube, in which the distance to the axis (7) of the tube is maximum, separating two side sections (5*b*, 5*c*) in which the distance to the axis (7) is decreasing toward the ends of the tube.

9 Claims, 4 Drawing Sheets

DISCHARGE SPOUT FOR FLEXIBLE BAGS

FIELD OF THE INVENTION

The invention is comprised in the field of flexible bags of the type known as a pouch and generally used to contain fluids or granules. These bags are provided with a rigid discharge spout which is sealed between the two walls forming the flexible bag.

The invention more specifically relates to a discharge spout for flexible bags of the type comprising a rigid plastic body forming a discharge passage and having a tube intended to be inserted between two walls of a flexible bag and being joined to such walls by means of sealing, said tube having a smooth outer surface and two opposite flat flaps extending externally in a mid-plane of said tube, said outer surface of the tube forming, together with the surface of said flat flaps, a sealing surface.

STATE OF THE ART

The discharge spouts referred to by the invention have the particularity that the mentioned outer surface of the tube which is sealed to the walls of the bag is smooth, in the sense that it is lacking ribs, such that the sealing with the walls of the flexible bag occurs on the entire said surface. Documents EP1434721A1, WO2005066037 and NL103085C disclose discharge spouts of this type, in which the outer surface of the tube is formed by two convex opposite faces mutually converging in respective edges from which the flat flaps extend. Document WO2007067029 describes a discharge spout in which the outer surface of the tube has a perfectly cylindrical shape.

The process which is used to make a closed flexible bag provided with a discharge spout of this type consists of inserting the tube of the discharge spout between two walls of said flexible bag and sealing these two walls to one another along the entire perimeter of the bag, as well as sealing each of said walls with the sealing surface of the discharge spout.

The main purpose of the flat flaps is to assure a progressive transition between, on one hand, the sealing area between each wall of the bag and the central part of the sealing surface and, on the other hand, the mutual sealing area between the two walls of the bag. This progressive transition prevents contact defects from occurring, which involve a loss of the leak-tightness of the bag.

In order to seal the walls of the flexible bag to the sealing surface of the tube, gripping jaws are used which press the walls of the bag against the sealing surface and heating is applied, which causes the surface of the plastic material of the tube and of the bag to melt, such that this melted plastic material acts as a sealing material.

A difficulty of this process is that due to the pressure exerted by the jaws, it is difficult to prevent the melted plastic material from flowing over the borders of the sealing surface, whereby it is difficult to obtain a satisfactory finish. Furthermore, if the plastic material flows over the upper edge, it runs the risk of damaging the elements of the discharge spout which are located near the tube, for example the elements forming the sealing system which these discharge spouts are usually provided with.

Document ES2300230A1 is a Spanish patent application of this applicant which discloses a discharge spout of the type indicated above, characterized in that the outer surface of the tube has, with respect to the axis of said tube, a radius increasing in the direction of the lower end of the tube. This particular shape of the tube allows performing the sealing operation with the walls of a flexible bag that prevents the melted plastic material from flowing over the borders of the sealing surface. Although this solution disclosed in document ES2300230A1 satisfactorily solves the drawbacks discussed above, it is not optimal with respect to the difficulty of developing an automated sealing process, nor with respect to the sealing quality obtained.

SUMMARY OF THE INVENTION

The objective of the invention is to provide a discharge spout of the type indicated above, which allows performing the sealing operation with the walls of a flexible bag with greater precision and such that the melted plastic material is prevented from flowing over the borders of the sealing surface, but obtaining an improved sealing quality with respect to the technology disclosed in the mentioned document ES2300230A1.

Another objective of the invention is to make the automated sealing process easier.

A discharge spout of the type indicated above has been developed for this purpose, characterized in that the outer surface of the tube is defined as having a middle area, that is in the axial direction of the tube, in which the distance to the axis of said tube is maximum, separating two side sections in which the distance to the axis of said tube is decreasing in the direction to the end opposite said middle area.

This particular shape of the tube according to the invention has the advantage that when the gripping jaws pressing the walls of the bag against the sealing surface of the tube are applied, said jaws first come into contact with the middle area of the tube, whereby the material initially melts in said middle area and extends progressively toward the two ends of the tube. The gripping of the jaws on the outer surface of the tube is not uniform, but rather it initially occurs in said middle area, such that in the two side sections the outer surface of the tube is separated from the surface of the jaws by a clearance corresponding to the difference of distance to the axis of the tube, said clearance being increasing toward the two ends of the tube. The plastic material of the tube therefore starts melting in said middle area, subjected to gripping by the jaws, and the melted material flows toward the two side sections, progressively filling the clearance existing between the inner surface of the jaws and the outer surface of the tube. As the plastic material gradually melts in the vicinity of the middle area, the jaws move forward, their gripping radius becoming narrower and the melted plastic material continues to flow toward the two ends of the tube, progressively filling the mentioned clearance.

This progressive sealing process, from the middle area toward the two ends of the tube, makes it considerably easier to maintain a centered position of the tube with respect to the jaws. Furthermore, the sealing is performed progressively and homogenously along the tube, whereby the end sealing quality is improved.

In addition to these supplementary advantages, the sealing spout according to the invention preserves the advantages of the discharge spout described in the mentioned document ES2300230A1: the melted plastic material is prevented from flowing over the outer edge of the sealing surface (as occurs with discharge spouts having a tube with a surface parallel to the axis of the tube) and the final shape of a flexible bag provided with the discharge spout according to the invention is improved.

Furthermore, this particular geometry of the outer surface of the tube according to the invention allows considerably reducing the thickness of the wall of the tube, whereby reducing the amount of plastic material necessary to manufacture the discharge spout. In fact, the preferred embodiments of the invention are characterized in that the wall forming the tube has throughout its entire extent, without including the flaps, a thickness less than or equal to one millimeter.

With respect to the shape of the tube in cross section, i.e., sectioned by a plane orthogonal to the longitudinal direction of the tube, several configurations can be provided, such as for example an ellipse shape or an ogive shape. However, for the purpose of making the sealing process easier, the outer surface of the tube preferably has, in a cross section according to a plane orthogonal to the axis of the tube, a circular shape.

In several optimal embodiments, which provide the best results with respect to the easiness of the sealing operation and to the sealing quality obtained, said middle area is in a centered position with respect to said two side sections. The distance occupied by said middle area, in the axial direction of said tube, is preferably less than or equal to one millimeter. As a result of this dimensional feature, the surface in which the material is initially melted is narrow, whereby the melted material flows more readily toward the two side sections on both sides of said middle area. In a particularly advantageous embodiment, the middle area is formed by the line of intersection between the two side sections, i.e., said middle area is substantially lacking thickness. The applicant has found that this particular configuration, with the middle area formed by a line without thickness, does not significantly affect the ease of centering the jaws because the initial melting is quick, an initial gripping area with sufficient thickness to assure centering being obtained in very little time. In contrast, the aforementioned advantage consisting of improving the creep of the melted material toward the two side sections is enhanced.

BRIEF DESCRIPTION OF THE DRAWINGS

Other advantages and features of the invention will be observed from the following description in which a preferred embodiment of the invention is described in a non-limiting manner, referring to the attached drawings. In the drawings.

DETAILED DESCRIPTION OF AN EMBODIMENT OF THE INVENTION

Figure 1:
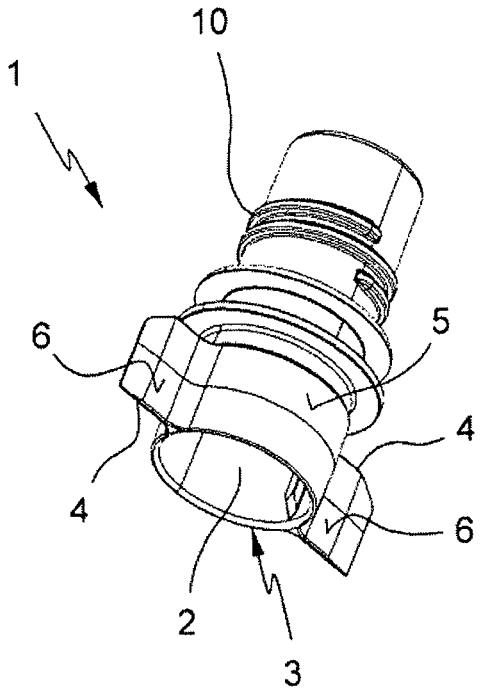
FIG. 1 shows a bottom perspective view of a discharge spout according to the invention.
Figure 2:
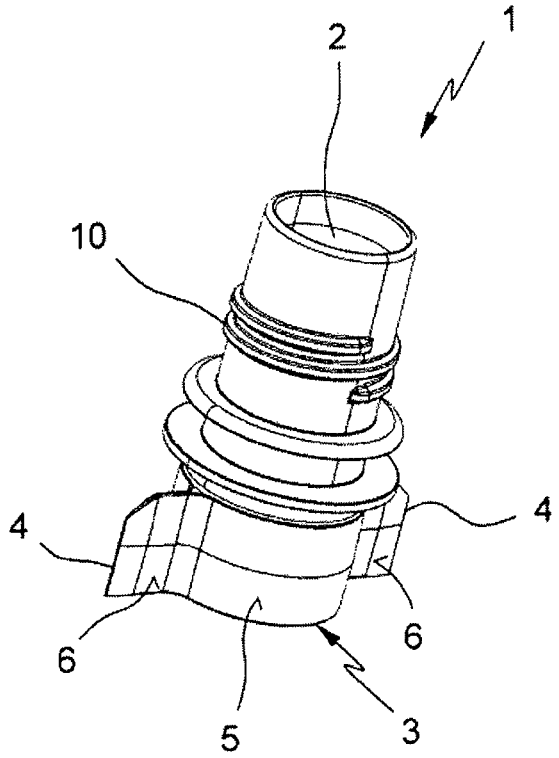
FIGS. 2, 3, 4 and 5 show, respectively, bottom perspective, bottom plan view, side elevational and front elevational views of the discharge spout.

FIG. 1 a 10 show a preferred, non-limiting embodiment of the discharge spout according to the invention. The closure cap which is coupled to the discharge spout has not been depicted in the drawings because the configuration of the closure cap is irrelevant for the purposes of the present invention and the design thereof involves no difficulty whatsoever for a person skilled in the art. As can be seen in the drawings, the discharge spout 1 is provided with a thread 10 for the screw-on coupling of the closure cap. However, any other type of coupling for the closure cap can be provided, such as for example a bayonet-type coupling, without affecting the essence of the invention.

The discharge spout 1 according to the invention is specifically designed to be applied to a flexible bag 11 known as a pouch and which are usually intended to contain a fluid or granulated product. As is known by a person skilled in the art, these pouch-type bags are plastic bags which are formed from two laminar walls sealed against one another on their perimeter to form a closed volume, trapping between one another a rigid discharge spout which is sealed to these walls.

Figure 3:
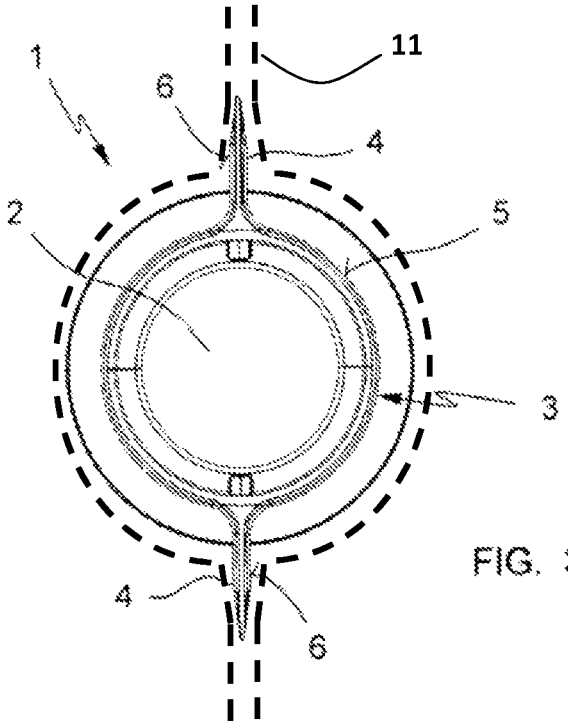
Figure 4:
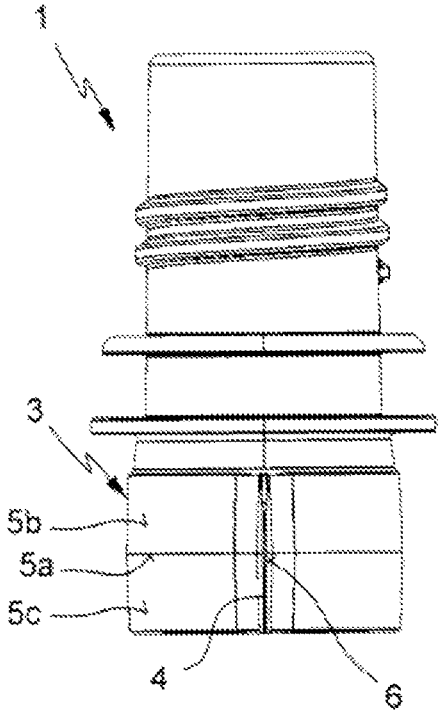
Figure 5:
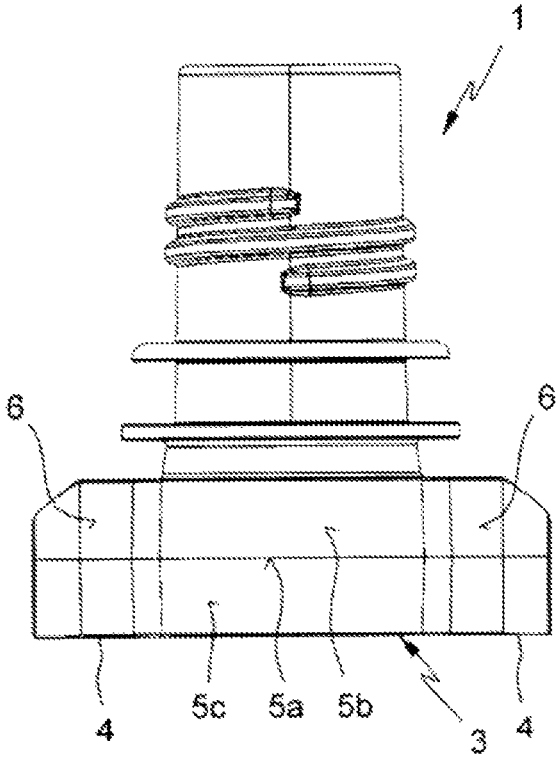
Figure 6:
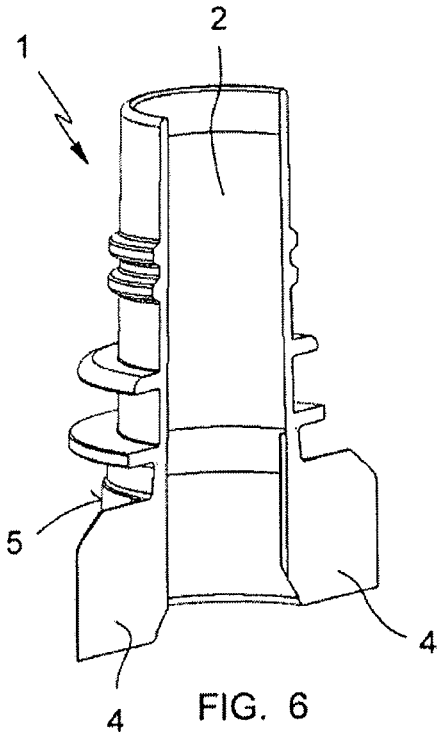
FIGS. 6 and 7 show, respectively, perspective and elevational views of the discharge spout, sectioned according to a vertical diametrical plane of FIG. 3.
Figure 7:
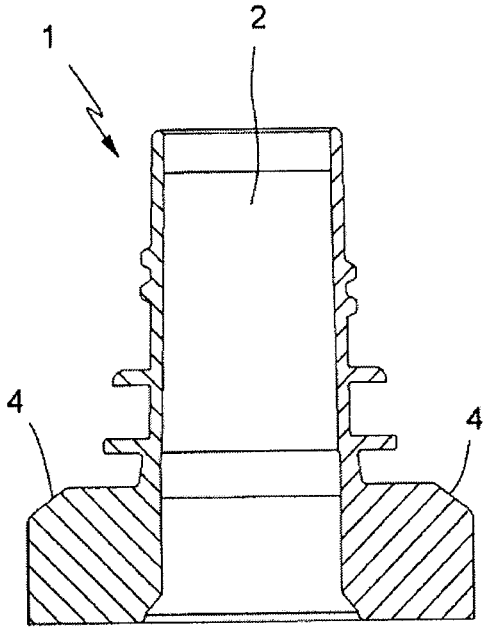
Figure 8:
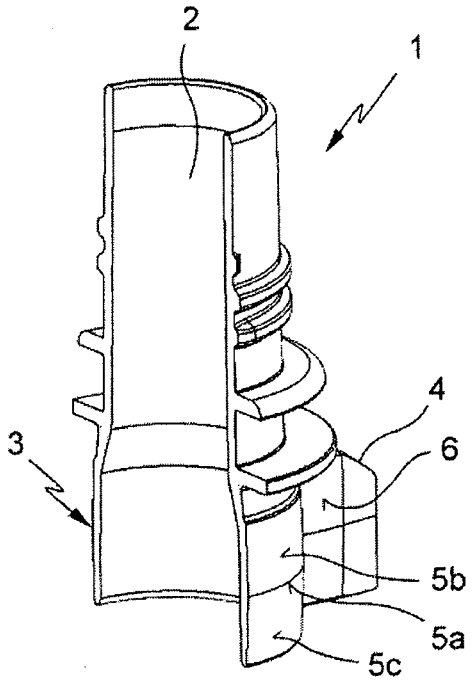
FIGS. 8 and 9 show, respectively, perspective and elevational views of the discharge spout, sectioned according to a horizontal diametrical plane of FIG. 3.

The discharge spout 1 is formed by a rigid plastic body internally defining a passage 2 intended to open at its lower end inside a flexible bag, whereas the outer end forms the pouring outlet of the bag which can be closed by means of the closure cap (not depicted). The lower part of this rigid body is a tube 3 forming a sealing surface by means of which the discharge spout 1 is sealed to the bag. The tube 3 has a smooth outer surface 5, formed by a surface of revolution around the axis 7 of the tube, from which two opposite flat flaps 4 extend in a mid-plane of the tube 3, as can be seen in the lower view of FIG. 3. The sealing surface is formed by the assembly of the outer surface 5 of the tube and the surface of the flat flaps 4.

In order to seal the discharge spout 4 to a flexible bag, the tube is inserted between the two walls of the bag, such that the flat flaps 4 are parallel to said walls. Jaws (not depicted) are used to press the walls of the bag against the sealing surface formed by the surfaces 5 and 6 and heating is applied, which causes the plastic material of the discharge spout 1 as well as the plastic material of the bag to melt in the area of the sealing surface.

Figure 9:
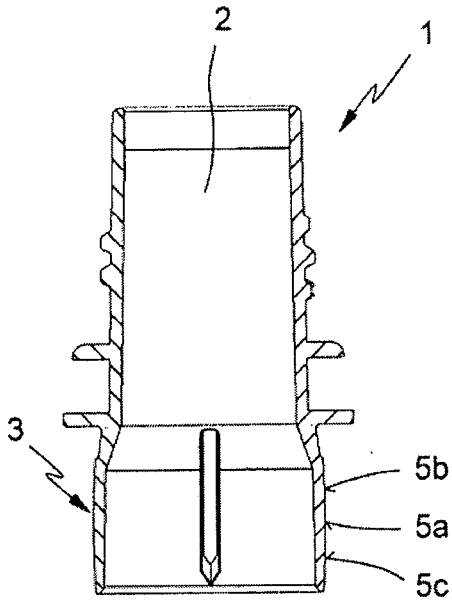
Figure 10:
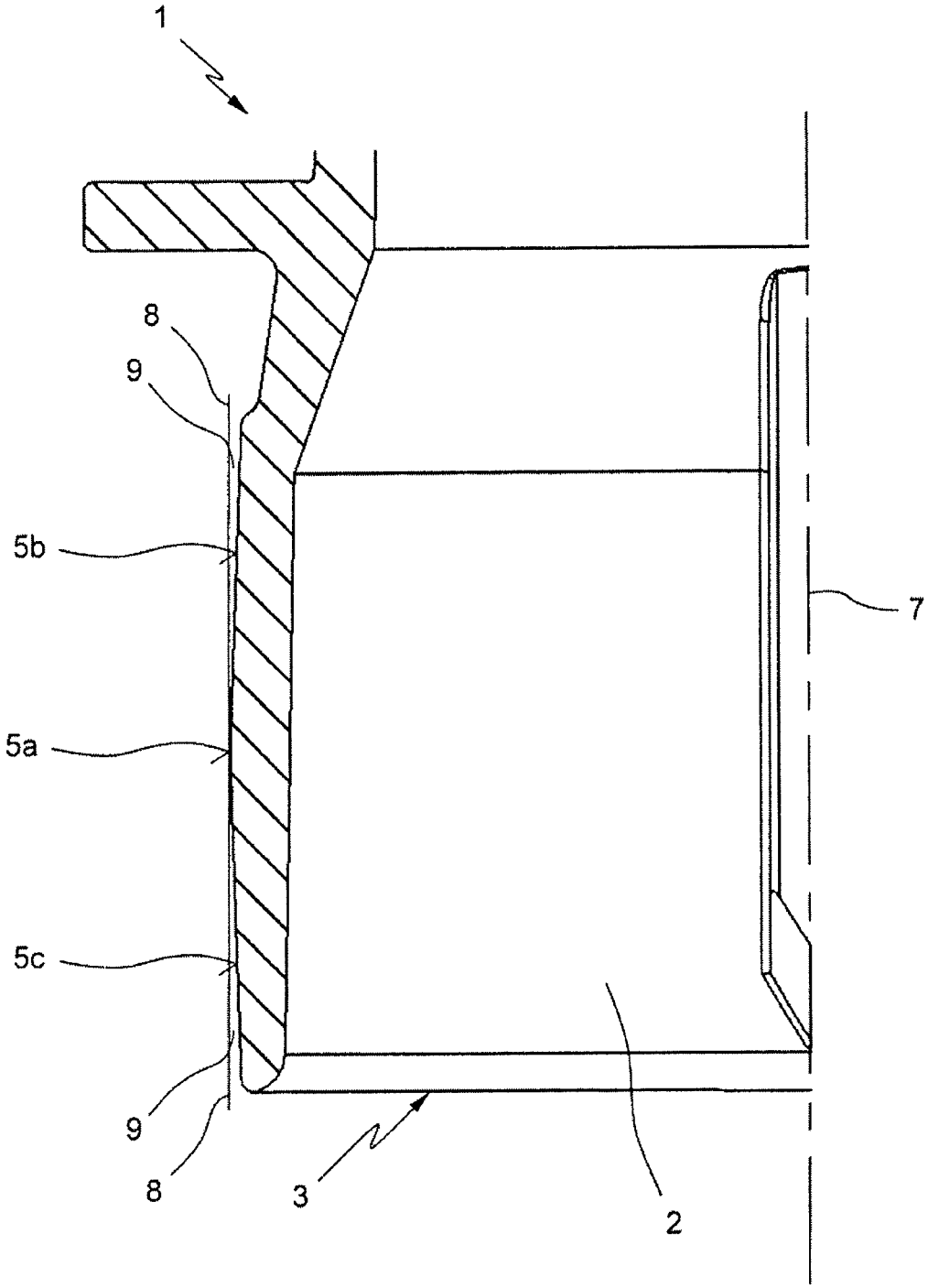
FIG. 10 shows a partial enlarged view of FIG. 9.

The essential feature of the discharge spout 1 according to the invention consists of the outer surface 5 of the tube has a middle area 5*a*, in the axial direction of said tube, separated by two side sections 5*b*, 5*c*, said middle area 5*a* being that of greater distance to the axis 7 of the tube, i.e., the peak of the dishing of the outer surface 5, whereas in the side sections 5*b*, 5*c* the distance to the axis 7 is decreasing from said middle area 5*a* toward the end opposite the same. This particular shape of the outer surface 5 of the tube is shown specifically in FIGS. 4, 5, 8, 9 and 10. Particularly, FIG. 10 is a partial depiction on an enlarged scale of the section view of FIG. 9, in which the dished shape of the outer surface of the tube can be more clearly seen. In order to show this shape, FIG. 10 includes an imaginary line 8 parallel to the axis 7 of the tube. The line 8 corresponds to the initial position of the inner surface of the jaw which is applied against the outer surface 5 of the tube to perform the sealing operation. As explained above, to perform the sealing the same type of jaw is used as for discharge spouts of the state of the art in which the outer surface of the tube is parallel to the axis 7, i.e., a jaw also having an inner surface parallel to the axis 7. In the initial position depicted by line 8 of FIG. 10, the inner surface of the jaw is applied against the middle area 5*a* of the outer surface of the tube, but separated from the side sections 5*b*, 5*c* by a clearance 9.

In the preferred embodiment depicted in FIGS. 1 to 10, the tube 3 has, in a cross section according to a plane orthogonal to the axis 7 of the tube, a circular shape. The middle area 5*a* is in a centered position with respect to the two side sections 5*b*, 5*c* and is formed by the line of intersection between said two side sections 5*b*, 5*c*, whereby said middle area 5*a* has a substantially nil width considered in the axial direction of the tube 3. In addition, the wall forming the tube 3 has throughout its entire extent, without including the flaps 4, a thickness less than or equal to one millimeter. In this embodiment, the maximum thickness of the wall forming the tube 3 is located in the middle area 5*a* and has a value of 0.8 mm.

The advantageous technical effects of this configuration according to the invention are those which have been explained above in the summary of the invention: as a result of the outwardly extending shape of the outer surface 5 of the tube, the material initially melts in the middle area 5*a* and progressively extends toward the two ends opposite said middle area through the side sections 5*b*, 5*c*, whereby making it considerably easier to maintain a centered position of the tube 3 with respect to the jaws and improving the sealing quality, while at the same time preventing the melted plastic material from flowing over the outer edge of the sealing surface and improving the final shape of the flexible bag after the sealing operation. Furthermore, the reduction of thickness of the wall of the tube 3, which is possible as a result of the outwardly extending shape of the outer surface, involves a reduction of the amount of plastic material necessary for manufacturing the discharge spout. The circular shape of the cross section of the tube 3 makes the sealing process easier; and the centered position and without substantial width of the middle area 5*a* makes the creep of the melted material toward the ends of the tube during the sealing process even easier.

The invention claimed is:

1. A discharge spout for flexible bags, said discharge spout comprising a rigid plastic body forming a discharge passage along an axis of the tube and having a tube intended to be inserted between two walls of a flexible bag and joined to such walls by sealing, said tube having a smooth outer surface and two opposite flat flaps extending externally in a mid-plane of said tube, said outer surface of the tube forming, together with the surface of said flat flaps, a sealing surface, said outer surface of the tube extending outwards relative to the axis and comprising a middle portion between a first side portion and a second side portion, the middle portion disposed further from the axis than the first side portion and the second side portion.

2. The discharge spout according to claim 1, wherein the wall forming said tube has throughout an entire extent of the wall, without including said flaps, a thickness less than or equal to one millimeter.

3. The discharge spout according to claim 1, wherein said outer surface of the tube has, in cross section in a plane orthogonal to the axis of the tube, a circular shape.

4. The discharge spout according to any one of claim 1, wherein said middle portion is in a centered position with respect to the first side portion and the second side portion.

5. The discharge spout according to claim 4, wherein a length of the middle portion along the axis, is less than or equal to one millimeter.

6. The discharge spout according to claim 5, wherein the middle portion is formed by an intersection of the first side portion and the second side portion.

7. A discharge spout for flexible bags, comprising:

a rigid plastic body forming a discharge passage and having a tube configured to be inserted between two walls of a flexible bag and joined to the walls by sealing;

the tube comprising a smooth outer surface about an axis of the tube and two opposite flat flaps extending externally in a mid-plane of the tube, the outer surface of the tube forming, together with the surface of the flat flaps, a sealing surface;

the outer surface of the tube direction of the tube, the having a middle portion in which a distance to the axis of the tube is maximum, separating two side portions of the outer surface, such that for each of the two side portions a distance from the surface to the axis of the tube gradually decreases in a direction away from the middle portion.

8. The discharge spout according to claim 7, wherein said middle portion is formed at an intersection of lines defining slopes of the two side portions.

9. A flexible bag assembly comprising the discharge spout according to claim 7 and a flexible bag sealed to the discharge spout.

* * * * *